US010654274B2

(12) United States Patent
Murayama et al.

(10) Patent No.: US 10,654,274 B2
(45) Date of Patent: May 19, 2020

(54) LIQUID EJECTING APPARATUS AND MAINTENANCE METHOD FOR THE SAME

(71) Applicant: SEIKO EPSON CORPORATION, Tokyo (JP)

(72) Inventors: Masato Murayama, Matsumoto (JP); Takeshi Yoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/180,275

(22) Filed: Nov. 5, 2018

(65) Prior Publication Data

US 2019/0134984 A1 May 9, 2019

(30) Foreign Application Priority Data

Nov. 7, 2017 (JP) ..... 2017-214913

(51) Int. Cl.
*B41J 2/16* (2006.01)
*B41J 2/165* (2006.01)

(52) U.S. Cl.
CPC ..... *B41J 2/1652* (2013.01); *B41J 2/16526* (2013.01); *B41J 2/16585* (2013.01); *B41J 2002/16573* (2013.01)

(58) Field of Classification Search
None
See application file for complete search history.

(56) References Cited

U.S. PATENT DOCUMENTS

2004/0036736 A1 2/2004 Suzuki
2007/0257956 A1 11/2007 Akase et al.
2008/0186343 A1* 8/2008 Sugahara ..... B41J 29/02 347/14
2009/0167813 A1* 7/2009 Mitchell ..... B41J 2/16526 347/23
2011/0128334 A1* 6/2011 Akiyama ..... B41J 2/17509 347/86
2013/0257933 A1 10/2013 Shirakawa et al.
2015/0321472 A1 11/2015 Koerner et al.

FOREIGN PATENT DOCUMENTS

JP 2000-289229 A 10/2000
JP 2004-017542 A 1/2004
JP 2007-136832 A 6/2007
(Continued)

*Primary Examiner* — Erica S Lin
(74) *Attorney, Agent, or Firm* — Workman Nydegger

(57) ABSTRACT

A liquid ejecting apparatus includes a liquid ejecting unit that performs printing on a target by ejecting liquid, which is supplied from a liquid supply source, from a plurality of nozzles; and a maintenance section that performs maintenance processing of causing the liquid to be discharged from the nozzles. Based on print information for performing printing on the target, in a case where printing satisfying a setting condition presumed such that a staying time of the liquid staying in a liquid path between the liquid supply source and the nozzles during printing is long is performed, a discharge amount of the liquid to be discharged during the maintenance processing that is performed before printing is set to be larger than a discharge amount of the liquid in a case where printing not satisfying the setting condition presumed such that the staying time is short is performed.

12 Claims, 9 Drawing Sheets

(56) References Cited

FOREIGN PATENT DOCUMENTS

| | | | |
|---|---|---|---|
| JP | 2008-044337 | A | 2/2008 |
| JP | 2010-228255 | A | 10/2010 |
| JP | 2012-183730 | A | 9/2012 |
| JP | 2013-226812 | A | 11/2013 |
| JP | 2014-000692 | A | 1/2014 |
| JP | 2015-214150 | A | 12/2015 |

* cited by examiner

LIQUID EJECTING APPARATUS AND MAINTENANCE METHOD FOR THE SAME

BACKGROUND

1. Technical Field

The present invention relates to a liquid ejecting apparatus such as an ink jet printer, and a maintenance method for the liquid ejecting apparatus.

2. Related Art

An example of a liquid ejecting apparatus may be an ink jet recording apparatus (for example, see JP-A-2000-289229 that performs printing on a recording medium (target) by discharging (ejecting) ink (liquid) from a recording head (liquid ejecting unit). With such a recording apparatus, nozzle openings (nozzles) that discharge ink may be clogged. To avoid this, with the recording apparatus, recovery processing (maintenance processing), such as flushing of causing ink droplets to be discharged from the nozzle openings regardless of printing, and cleaning of sucking ink from the nozzle openings, has been performed.

The recovery processing has been performed in a mode selected based on information before printing. Specifically, the recording apparatus has performed flushing if the time in which the recording head performs printing without being capped, the time which has elapsed since the previous recovery operation has been executed, and the time in which the recording head is capped are short, and the recording apparatus has performed cleaning if these times are long.

The recording apparatus supplies ink to the nozzle openings from an ink cartridge (liquid supply source) via an ink supply path (liquid path). The amount of air bubbles and abnormal substances contained in the ink in the ink supply path may be increased during printing. Hence, when printing is performed in accordance with print specifications which likely cause increases in air bubbles and abnormal substances as long as merely the recovery processing is performed based on the information before printing, the ink may not be stably supplied.

The issue is not applied to only the recording apparatus that discharges ink droplets from the nozzle openings, but is mostly common to liquid ejecting apparatuses that eject ink from nozzles.

SUMMARY

An advantage of some aspects of the invention is to provide a liquid ejecting apparatus capable of stably supplying liquid to nozzles, and a maintenance method for the liquid ejecting apparatus.

A measure for addressing the issue is described below.

According to an aspect of the invention, a liquid ejecting apparatus includes a liquid ejecting unit that performs printing on a target by ejecting liquid from a plurality of nozzles; a liquid supply channel configured to supply the liquid which is stored in a liquid supply source toward the liquid ejecting unit; a maintenance section that performs maintenance processing of causing the liquid to be discharged from the nozzles; and a controller that, based on print information for performing printing on the target, determines printing satisfying a setting condition if a staying time of the liquid staying in a liquid path including the liquid supply channel and a channel extending from the liquid supply channel to the nozzles during printing is presumed to be long, and determines printing not satisfying the setting condition if the staying time is presumed to be short. The controller, in a case where the printing satisfying the setting condition is performed, sets a discharge amount of the liquid to be discharged during the maintenance processing that is performed before printing to be larger than a discharge amount of the liquid in a case where the printing not satisfying the setting condition is performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of a liquid ejecting apparatus and a maintenance method for the liquid ejecting apparatus are described below with reference to the drawings. The liquid ejecting apparatus is, for example, an ink jet printer that performs recording (printing) by ejecting ink, which is an example of liquid, onto a target such as a sheet of paper or a fabric such as a T-shirt.

Figure 1:
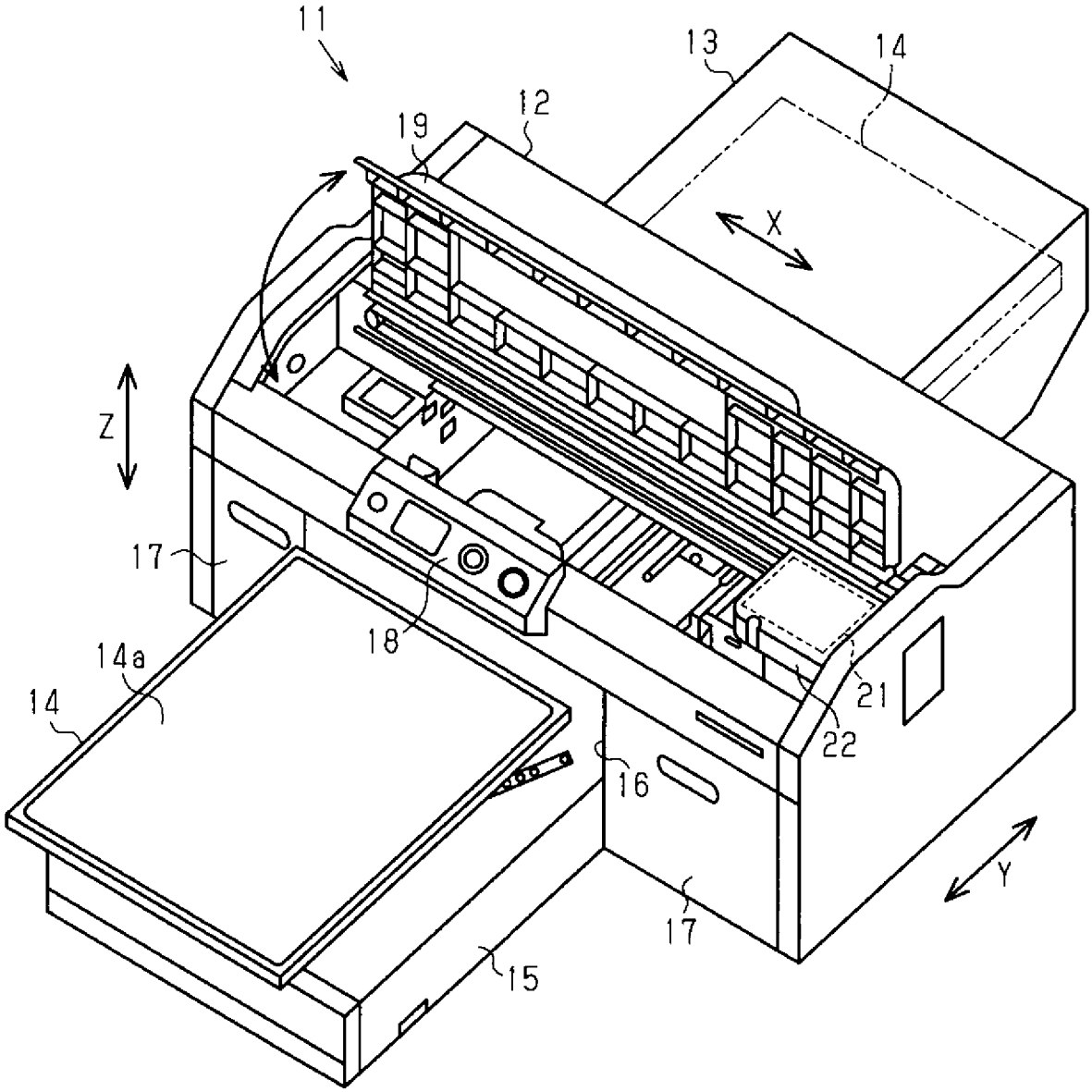
FIG. 1 is a perspective view of an embodiment of a liquid ejecting apparatus.

As illustrated in FIG. 1, a liquid ejecting apparatus 11 includes substantially rectangular box-shaped first housing 12 and second housing 13. In this embodiment, the side provided with the first housing 12 is referred to as front side and the side provided with the second housing 13 is referred to as rear side for the liquid ejecting apparatus 11. The direction which intersects with (in this embodiment, orthogonal to) an up/down direction Z along the vertical direction and in which the first housing 12 and the second housing 13 are arranged is illustrated as front/rear direction Y. The direction which intersects with (in this embodiment, orthogonal to) the up/down direction Z and the front/rear direction Y and which is along the longitudinal direction of the first housing 12 is illustrated as width direction X.

A medium transport section 15 is fixed to the first housing 12 in a manner protruding forward from the first housing 12. The medium transport section 15 supports a medium support tray 14 so as to transport the medium support tray 14 in the front/rear direction Y. An opening 16 is formed in the front surface of the first housing 12. The opening 16 allows the movement of the medium support tray 14 in the front/rear direction Y. A space (not shown) that allows the movement of the medium support tray 14 is formed in the first housing 12 and the second housing 13 so as to extend from the first housing 12 to the second housing 13. In the following description, the space formed to extend from the first housing 12 to the second housing 13, and the opening formed in the front surface of the first housing 12 are collectively referred to as opening 16.

The upper surface of the medium support tray 14 serves as a set surface 14*a* on which a target T (see FIG. 3) can be set. The medium support tray 14 is movable between a medium set position indicated by solid lines in FIG. 1, and a print start position indicated by two-dot chain lines in FIG. 1. The medium set position is a position at which the medium support tray 14 is exposed from the first housing 12, and at which the target T can be set on the set surface 14*a*. The medium support tray 14 reciprocates in the front/rear direction Y between the medium set position and the print start position with driving of a transport motor (not shown).

An opening/closing cover 17 is rotatably attached to the front surface of the first housing 12, at a position on each of both sides of the opening 16 in the width direction X. The opening/closing cover 17 is arranged at a closed position shown in FIG. 1, and an open position at which an upper end portion thereof swings forward and downward and the inside of the first housing 12 is exposed, by rotating the opening/closing cover 17 such that the upper end thereof swings around a rotating shaft (not shown) provided at the lower end thereof.

An operation panel 18 is attached above the opening 16. The operation panel 18 displays the operating state of each component included in the liquid ejecting apparatus 11, and receives an input instruction. An upper cover 19 is provided rotatably on the rear side of the operation panel 18. The upper cover 19 is arranged at an open position shown in FIG. 1, and a closed position at which the distal end thereof swings forward and downward from the open position and the contents in the first housing 12 are hidden, by rotating the upper cover 19 around a rotating shaft (not shown) provided on the proximal end thereof.

The liquid ejecting apparatus 11 includes a liquid ejecting unit 21 that ejects liquid, and a holder 22 that holds the liquid ejecting unit 21. The holder 22 in this embodiment is a carriage that holds a liquid ejecting unit 21 of serial type and reciprocates across the target T. Alternatively, the holder 22 may arrange a liquid ejecting unit 21 of line head type by fixing the liquid ejecting unit 21 in a transport path for the target T.

Figure 2:
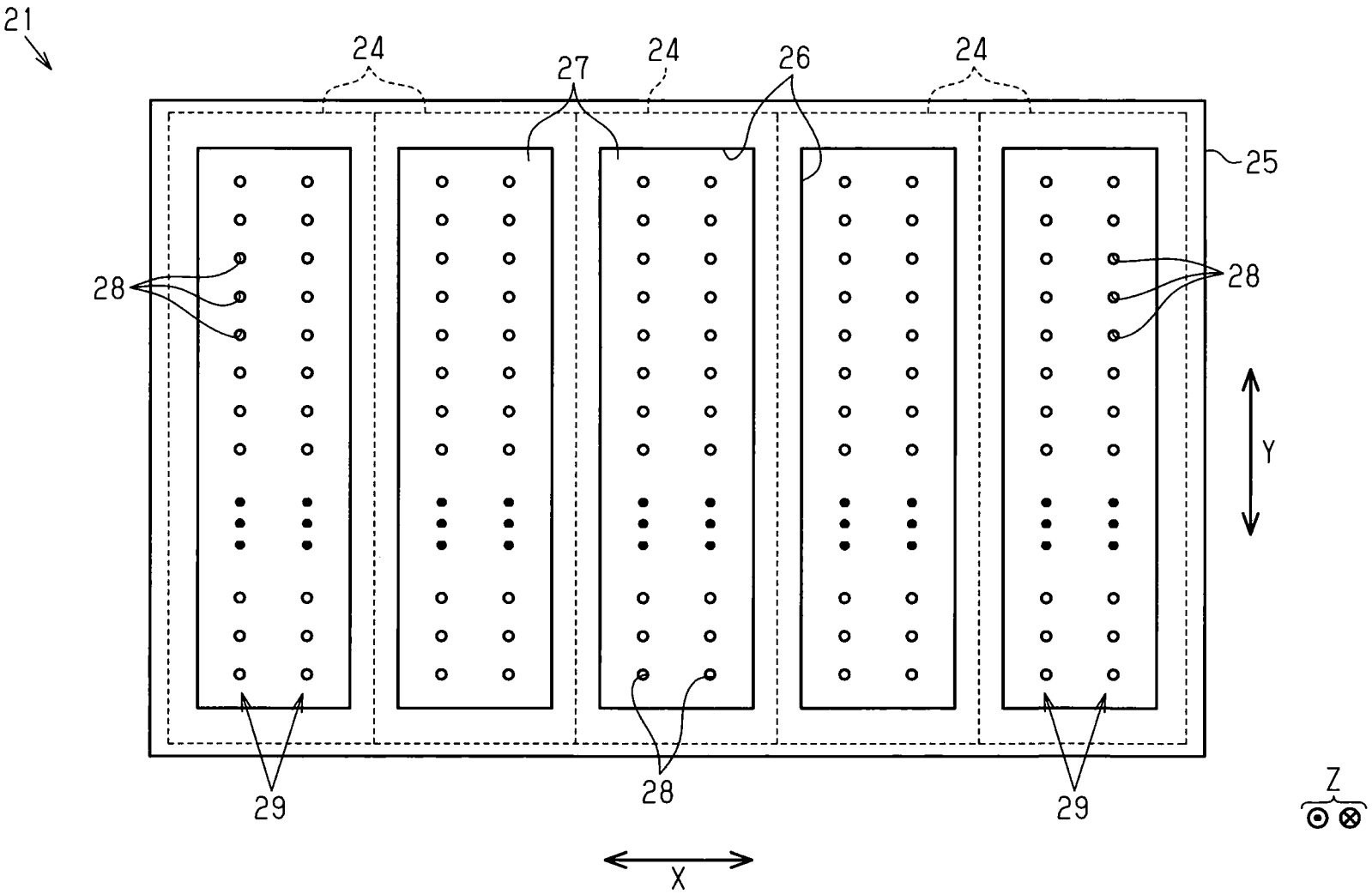
FIG. 2 is a schematic bottom view of a liquid ejecting unit included in the liquid ejecting apparatus in FIG. 1.

As shown in FIG. 2, the liquid ejecting unit 21 has a plurality of (in this embodiment, five) head units 24 arranged in the width direction X. The plurality of head units 24 are covered with a metal sheet 25 from below and held by the metal sheet 25 that is bent upward and extends in the width direction X and the front/rear direction Y. The metal sheet 25 has the same number of through holes 26 as the number of head units 24. The lower surfaces of the head units 24 exposed from the rectangular through holes 26 serve as nozzle formation surfaces 27. The nozzle formation surfaces 27 each have multiple nozzles 28 formed therein. The liquid ejecting unit 21 performs printing on the target T (see FIG. 3) by ejecting the liquid from the plurality of nozzles 28.

In this embodiment, a plurality of nozzles 28 formed at one head unit 24 serve as one nozzle group 29. The liquid ejecting unit 21 in this embodiment has the same number of (five) nozzle groups 29 as the number of head units 24. In other words, the liquid ejecting unit 21 has a plurality of nozzle groups 29.

For the nozzles 28 constituting one nozzle group 29, multiple (for example, 180 or 360) nozzles are arranged at a constant pitch in the front/rear direction Y, and form at least one nozzle row (in this embodiment, two nozzle rows). The plurality of nozzles 28 constituting one nozzle group 29 eject liquid of the same kind. The nozzles 28 constituting different nozzle groups 29 eject liquid of different kinds. The plurality of nozzle groups 29 are formed to correspond to a plurality of kinds of liquid so as to eject a plurality of kinds of liquid.

Figure 3:
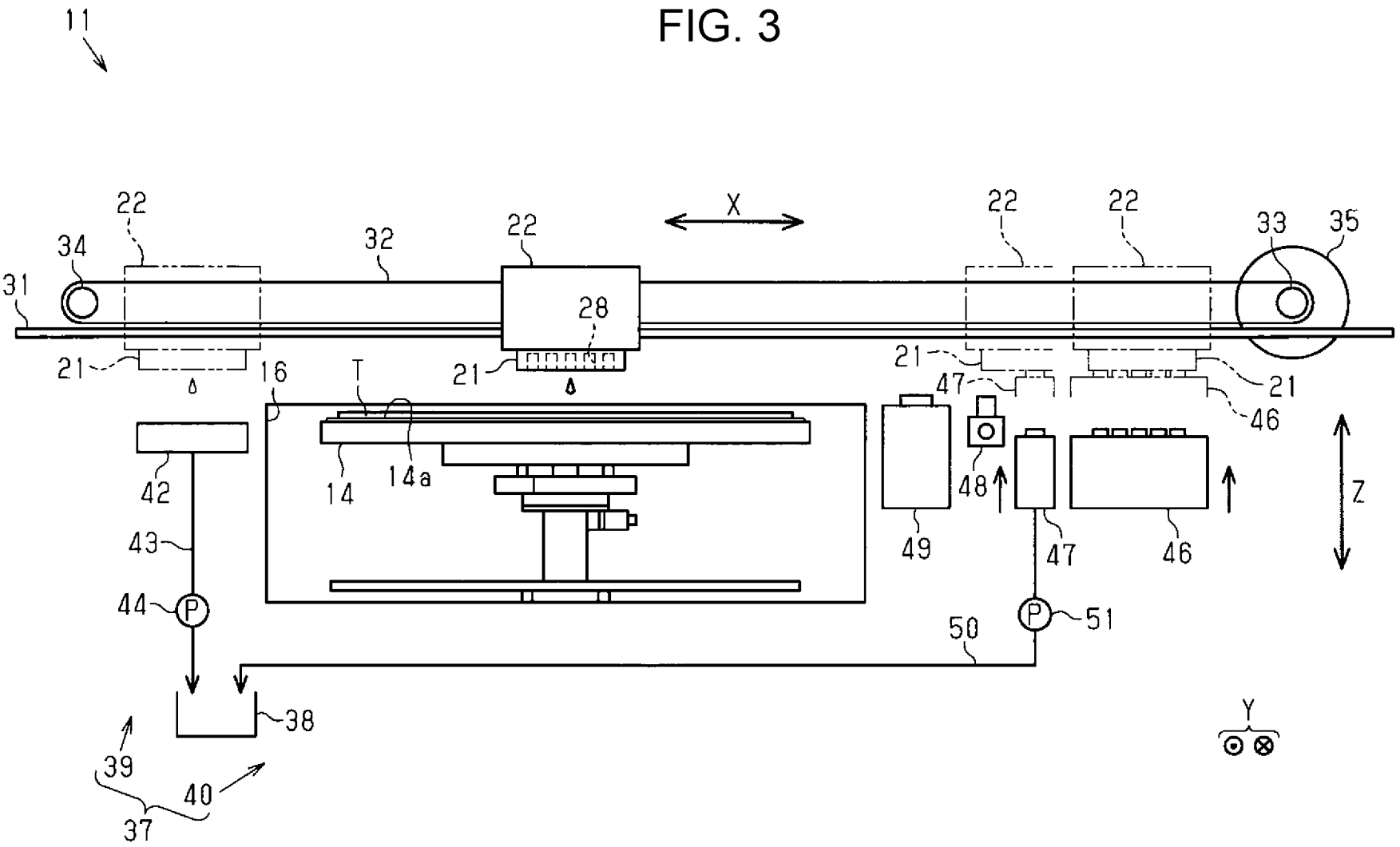
FIG. 3 is a schematic front view showing the inner configuration of a first housing included in the liquid ejecting apparatus in FIG. 1.

As shown in FIG. 3, a guide shaft 31 that extends in the width direction X is provided in the first housing 12. The guide shaft 31 supports the holder 22 so as to reciprocate in the width direction X, which is an example of a main-scanning direction. Further, a driving pulley 33 and a driven pulley 34 are rotatably supported in the first housing 12. A timing belt 32 part of which is fixed to the holder 22 is wound around the driving pulley 33 and the driven pulley 34. The driving pulley 33 is coupled to a carriage motor 35. When the timing belt 32 rotates by driving of the carriage motor 35, the holder 22 and the liquid ejecting unit 21 reciprocate in the width direction X.

The liquid ejecting apparatus 11 includes a maintenance section 37 for performing maintenance for the liquid ejecting unit 21, and a waste liquid container 38 that stores waste liquid which is discharged from the liquid ejecting unit 21 due to the maintenance. The maintenance section 37 performs maintenance processing of causing the liquid to be discharged from the nozzles 28. Specifically, the maintenance section 37 performs maintenance for the liquid ejecting unit 21 to prevent or address an ejection failure caused by clogging of the nozzles 28, mixing of air bubbles into the liquid ejecting unit 21, or adhesion of abnormal substances to the periphery of the nozzles 28.

The maintenance processing includes flushing of driving actuators 69 (see FIG. 5) included in the liquid ejecting unit 21 and causing the liquid to be ejected, and suction cleaning of sucking and discharging the liquid from the liquid ejecting unit 21. The flushing is performed as pre-print flushing for the maintenance processing that is performed before printing, and in-print flushing for the maintenance processing that is performed during printing.

The maintenance section 37 includes a flushing unit 39 provided on one side in the width direction X and a cleaning unit 40 provided on the other side in the width direction X with the opening 16 arranged therebetween. The flushing unit 39 and the cleaning unit 40 are provided at positions shifted from the position of the opening 16 in the width direction X so as not to interfere with the medium support tray 14 that moves in the front/rear direction Y. The position at which the cleaning unit 40 is provided is a home position.

The flushing unit 39 receives the liquid ejected from the liquid ejecting unit 21 by flushing. The flushing is an operation of discharging the liquid from the nozzles 28, and hence discharging abnormal substances, air bubbles, or degraded liquid (for example, ink with viscosity increased) which may cause an ejection failure. The flushing is performed to address a slight ejection failure.

The flushing unit 39 includes a flushing box 42, a flushing tube 43 connected to the flushing box 42, and a flushing pump 44 configured to suck the inside of the flushing box 42. The upstream end of the flushing tube 43 is connected to the flushing box 42, and the downstream end thereof is connected to the waste liquid container 38. The flushing pump 44 is provided at an intermediate position of the flushing tube 43. The flushing pump 44 may be, for example, a tube pump. Alternatively, any of other types of pumps may be used.

The cleaning unit 40 includes a moisturizing cap 46, a suction cap 47, a wiper 48, and an absorbing member 49. The cleaning unit 40 includes a suction tube 50 that connects the suction cap 47 with the waste liquid container 38, and a suction pump 51 configured to suck the inside of the suction cap 47. The suction pump 51 is provided at an intermediate position of the suction tube 50. The suction pump 51 may be, for example, a tube pump. Alternatively, any of other types of pumps may be used.

At least one of a set of he moisturizing cap 46 and the suction cap 47, and the liquid ejecting unit 21 is configured to relatively move between a capping position at which the space where the nozzles 28 are open is a closed space, and a retraction position at which the space where the nozzles 28 are open is an open space. The moisturizing cap 46, the suction cap 47, and the liquid ejecting unit 21 are arranged at the capping position, and hence capping is provided.

The moisturizing cap 46 forms a closed space where all the nozzles 28 are covered at once. The moisturizing cap 46 provides capping when the liquid is not ejected. By preventing drying of the nozzles 28, occurrence of an ejection failure is prevented. The moisturizing cap 46 is used to prevent evaporation of ink in each nozzle 28 of the liquid ejecting unit 21 when printing is suspended or when the apparatus is not used.

The suction cap 47 contacts the liquid ejecting unit 21 and forms a space containing the nozzles 28. The suction cap 47 forms a closed space that covers one nozzle group 29 formed at one head unit 24. The suction cap 47, the suction tube 50, and the suction pump 51 perform suction cleaning of sucking and discharging the liquid from the liquid ejecting unit 21.

The suction cleaning is performed by causing a negative pressure which is generated by driving of the suction pump 51 to act on the closed space formed by arranging the suction cap 47 at the capping position. When a negative pressure acts on the liquid ejecting unit 21, the liquid is sucked and discharged from the nozzles 28. That is, in the suction cleaning, the suction pump 51 applies a negative pressure to the liquid ejecting unit 21 and causes the liquid in the liquid ejecting unit 21 to be discharged to the outside.

The wiper 48 wipes the nozzle formation surface 27 by contacting the nozzle formation surface 27 while being elastically deformed. The absorbing member 49 absorbs the ink adhering to the nozzle formation surface 27 by contacting the nozzle formation surface 27.

The flushing unit 39 and the cleaning unit 40 may be detachably attached to the first housing 12, and may be replaceable. The flushing unit 39 and the cleaning unit 40 are accessible by displacing the upper cover 19 to the open position shown in FIG. 1. Thus, the maintenance and replacement for the flushing unit 39 and the cleaning unit 40 can be easily performed.

Figure 4:
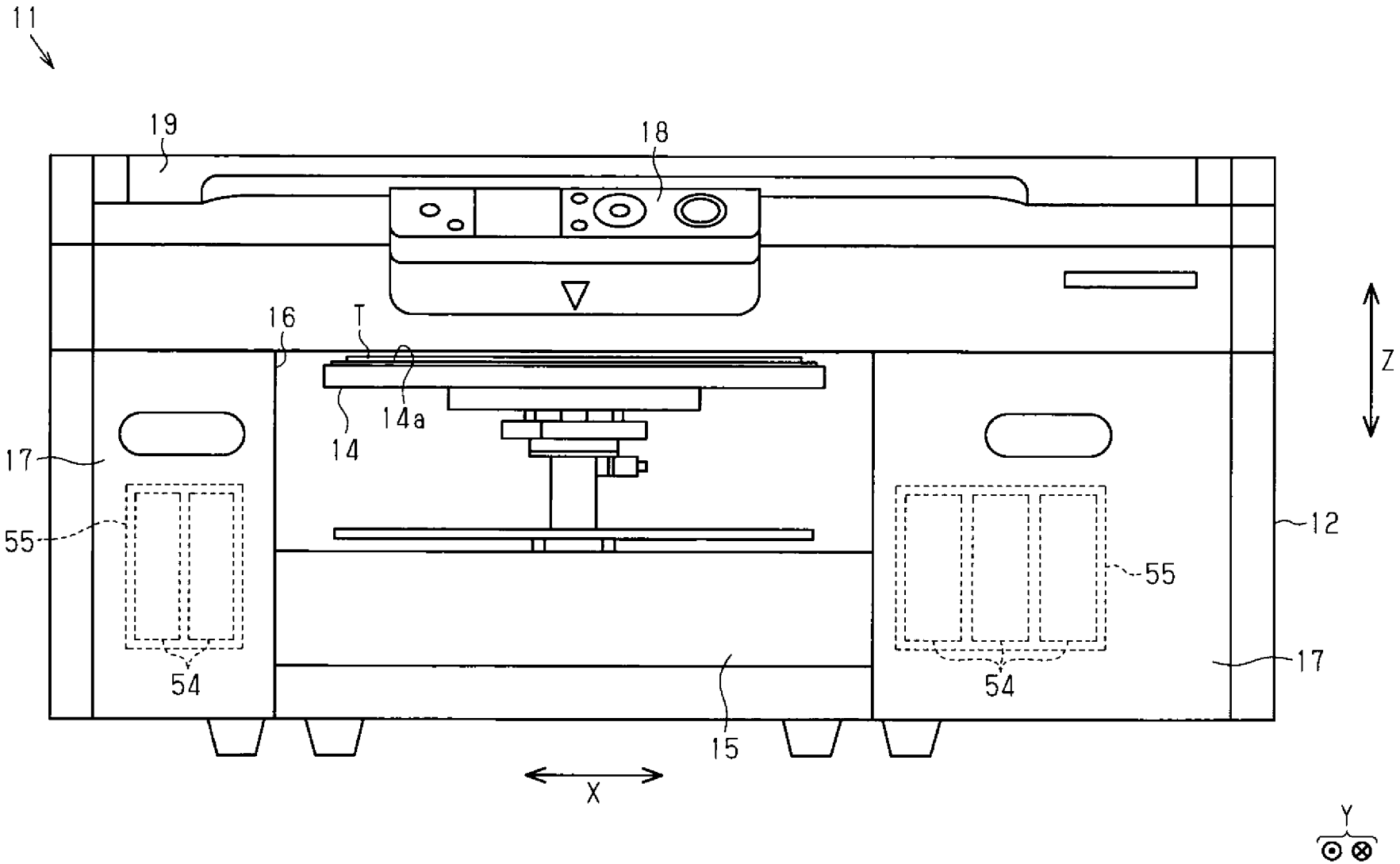
FIG. 4 is a front view of the liquid ejecting apparatus in FIG. 1.

As shown in FIG. 4, the liquid ejecting apparatus 11 includes an attachment portion 55 to which a liquid supply source 54 that stores the liquid such as ink is detachably attached. The attachment portion 55 may be provided on each of both sides in the width direction X in the first housing 12 such that the opening 16 is arranged therebetween. The liquid supply source 54 attached to the attachment portion 55 appears and is replaceable when the opening/closing cover 17 is arranged at the open position.

At least one (for example, five) liquid supply source 54 is attached to the attachment portion 55 in this embodiment. If a plurality of liquid supply sources 54 are attached, the liquid supply sources 54 may store different kinds of liquid. For example, one liquid supply source 54 may store ink containing a pigment that precipitates in water serving as a solution (for example, white ink containing a white pigment). The other liquid supply sources 54 may each store ink not containing a pigment or less containing a pigment (for example, color ink of cyan, magenta, or yellow). One liquid supply source 54 may store a plurality of kinds of liquid.

The plurality of kinds of liquid which are stored in the plurality of liquid supply sources 54 include liquid which is used for base printing. The base printing is performed before main printing, for example, when printing is performed on a target T with dark color such as a black T-shirt. When base printing is to be performed, base printing is performed first by using white ink, which is an example of liquid for base printing, and then main printing is performed by using color ink, which is an example of liquid for main printing, on the outcome of base printing.

Figure 5:
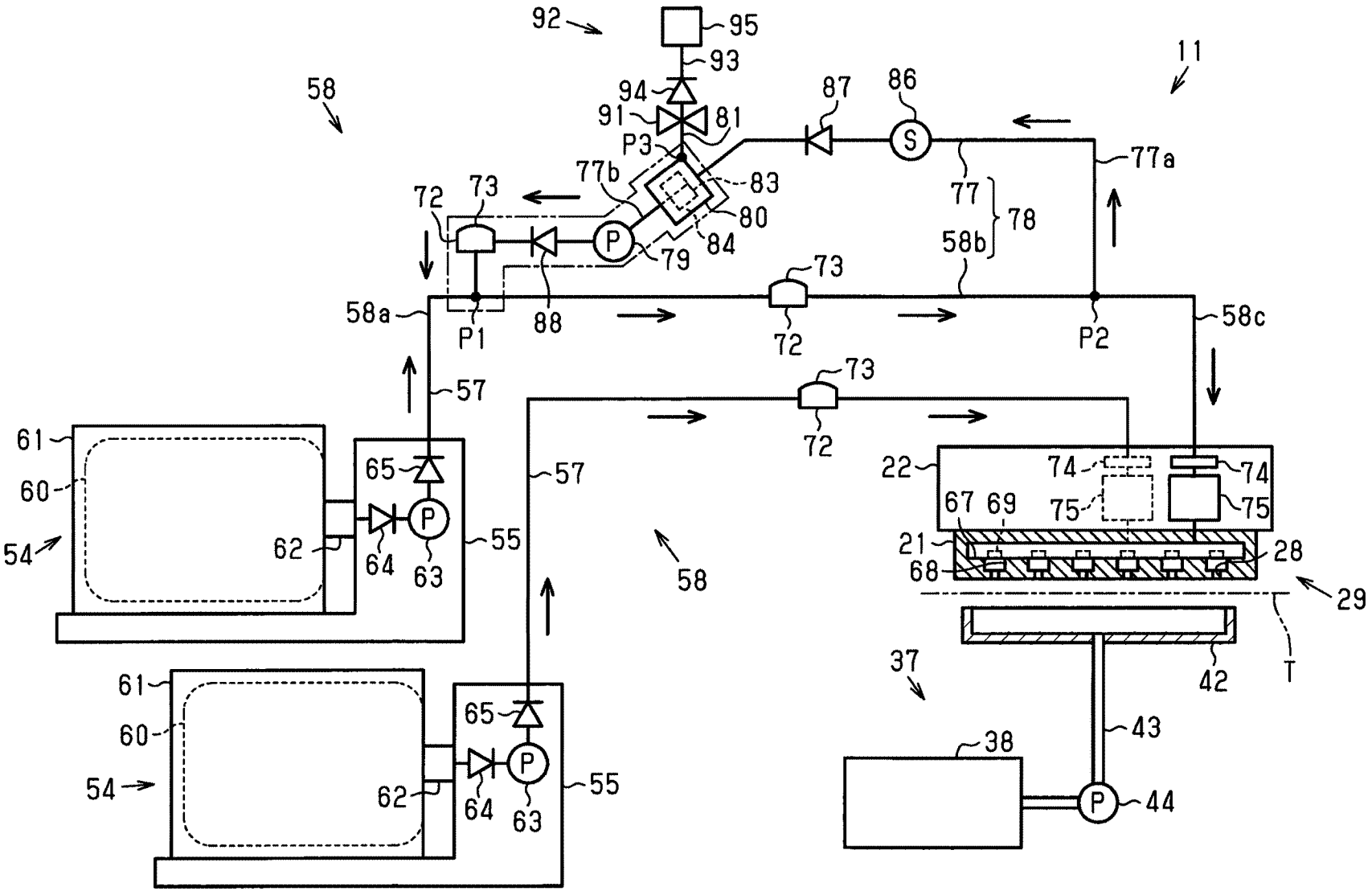
FIG. 5 is a schematic view of liquid paths included in the liquid ejecting apparatus in FIG. 1.

As shown in FIG. 5, the liquid ejecting apparatus 11 includes a liquid supply channel 57 configured to supply the liquid which is stored in the liquid supply source 54 toward the liquid ejecting unit 21. In this embodiment, the liquid supply channel 57 and a channel extending from the liquid supply channel 57 to the nozzles 28 are collectively referred to as liquid path 58. A plurality of liquid paths 58 are provided so as to supply a plurality of kinds (for example, colors of ink) of liquid which are stored in the liquid supply sources 54 toward a plurality of corresponding nozzle groups 29.

The liquid supply source 54 includes a bag 60 that stores, for example, liquid, a case 61 that houses the bag 60, and an outlet portion 62 that leads the liquid stored in the bag 60 to the outside of the case 61. The attachment portion 55 includes a supply pump 63 that supplies, with a pressure, the liquid stored in the liquid supply source 54 toward the liquid ejecting unit 21.

The supply pump 63 is, for example, a diaphragm pump. An upstream one-way valve 64 is provided upstream of the supply pump 63. A downstream one-way valve 65 is provided downstream of the supply pump 63. The supply pump 63 may be, for example, a tube pump, or a gas supply pump that supplies the liquid by supplying a pressurized gas into the case 61 and squeezing the bag 60. If the supply pump 63 is a tube pump or a gas supply pump, the upstream one-way valve 64 and the downstream one-way valve 65 may not be provided.

The liquid ejecting unit 21 includes a common liquid chamber 67 that temporarily stores the liquid, and a plurality of cavities 68 provided to individually correspond to the plurality of nozzles 28. The liquid ejecting unit 21 includes a plurality of actuators 69 provided to individually correspond to the respective cavities 68 that store the liquid. The liquid is ejected from the nozzles 28 by driving of the actuators 69.

If a reservoir 72 that temporarily stores the liquid is provided at an intermediate position in the liquid supply channel 57, the pressure of the liquid to be supplied to the liquid ejecting unit 21 is stabilized. The reservoir 72 may be an open tank the inside of which is open to the atmosphere. Alternatively, if the reservoir 72 is a closed reservoir having wall surfaces partly formed of a flexibly displaceable film 73, gas is not mixed to the liquid.

The liquid ejecting apparatus 11 includes a first filter 74 provided in the liquid path 58 and serving as an example of a filter that allows liquid to pass therethrough and that can collect abnormal substances in the liquid. The first filter 74 may be provided desirably upstream of the common liquid chamber 67. The first filter 74 has collection performance that can collect abnormal substances which cannot pass through the liquid ejecting unit 21. If the liquid ejecting apparatus 11 includes the holder 22, the holder 22 may hold the first filter 74.

If a pressure regulating mechanism 75 that regulates the pressure of the liquid which is supplied with a pressure is provided upstream of the common liquid chamber 67, the pressure of the liquid to be supplied to the nozzles 28 is stabilized. The holder 22 may hold the pressure regulating mechanism 75. When the holder 22 holds the first filter 74 and the pressure regulating mechanism 75, the first filter 74 and the pressure regulating mechanism 75 reciprocate in the width direction X (see FIG. 3) with the movement of the holder 22.

The liquid supply channel 57 that supplies liquid containing a precipitable component such as white ink is provided with a return channel 77 having both ends connected to the liquid supply channel 57. Both the ends of the return channel 77 include a first end that is connected to a first position P1 of the liquid supply channel 57, and a second end that is opposite to the first end and that is connected to a second position P2 of the liquid supply channel 57. The second position P2 is closer to the nozzles 28 than the first position P1. That is, the second end is connected to the second position P2 that is closer to the nozzles 28 than the first position P1.

The liquid path 58 includes an upstream channel 58*a* extending from the liquid supply source 54 to the first position P1, an intermediate channel 58*b* extending from the first position P1 to the second position P2, and a downstream channel 58*c* having a liquid path extending from the second position P2 to the liquid ejecting unit 21 and liquid paths to the nozzles 28 of the liquid ejecting unit 21.

The liquid supply channel 57 and the return channel 77 constitute a circulation channel 78. The reservoir 72 may be provided in the intermediate channel 58*b* that is located between the first position P1 and the second position P2 of the liquid supply channel 57 to which the return channel 77 is connected, and that constitutes the circulation channel 78. The direction in which fluid flows in the liquid supply channel 57 and the return channel 77 is indicated by arrows in FIG. 5. The supply pump 63 is arranged in the upstream channel 58*a* that is closer to the liquid supply source 54 than the first position P1 of the liquid supply channel 57, and supplies the liquid from the liquid supply source 54 toward the liquid ejecting unit 21.

The liquid ejecting apparatus 11 includes a circulation pump 79 that can cause the fluid in the circulation channel 78 to flow, a filter unit 80 that constitutes a portion of the return channel 77 and that is replaceable, and a communication channel 81 that is connected to the return channel 77 in a manner that allows the return channel 77 to communicate with the outside.

The circulation pump 79 is, for example, a tube pump. The tube pump presses a tube forming a channel and sends the fluid with a pressure when rotationally driven in one direction. The tube pump releases the pressure on the tube and allows the fluid to flow therethrough when rotationally driven in the opposite direction. The direction in which the circulation pump 79 sends the liquid with a pressure in the circulation channel 78 (the direction indicated by arrows in FIG. 5) is a flowing direction. That is, the circulation pump 79 causes the fluid in the circulation channel 78 to flow in the flowing direction. The circulation pump 79 causes the fluid to circulate with a pressure that does not break the menisci formed at the nozzles 28.

The circulation pump 79 may be another type of pump such as a diaphragm pump. The liquid ejecting apparatus 11 drives the circulation pump 79 when not performing printing to circulate the liquid in the circulation channel 78 and hence to stir the liquid, thereby preventing or addressing precipitation of a pigment or the like.

The filter unit 80 includes a second filter 83 that collects abnormal substances, and an upstream filter chamber 84 that stores the liquid on the primary side before passing through the second filter 83. The communication channel 81 may be connected to the upstream filter chamber 84. The gas collected by the second filter 83 is accumulated in the upstream filter chamber 84. Hence, if the communication channel 81 is connected to the upstream filter chamber 84, the collected gas is discharged to the outside through the communication channel 81.

If the second filter 83 serves as an upstream filter, the first filter 74 arranged in the downstream channel 58*c* extending from the second position P2 of the liquid supply channel 57 toward the nozzles 28 serves as a downstream filter. The first filter 74 serving as the downstream filter may have lower performance of collecting abnormal substances than the performance of the second filter 83 serving as the upstream filter.

The circulation pump 79 is arranged between a connection position P3 to which the communication channel 81 is connected in the return channel 77, and the first position Pl. The connection position P3 is located between the first end and the second end of the return channel 77. In this embodiment, the return channel 77 has a branch channel 77*a* extending from the connection position P3 to the second position P2. A region provided with the branch channel 77*a* is referred to as "branch region." The return channel 77 has a joint channel 77*b* extending from the connection position P3 to the first position P1. A region provided with the joint channel 77*b* (approximate region surrounded by two-dot chain lines in FIG. 5) is referred to as "joint region."

In the branch region, a pressure sensor 86 may be provided. The pressure sensor 86 can detect the pressure in the return channel 77 that constitutes the circulation channel 78. The liquid ejecting apparatus 11 may include at least one one-way valve (in this embodiment, two valves of a first one-way valve 87 and a second one-way valve 88) that is provided in the circulation channel 78, that allows a flow of the fluid in the flowing direction in the circulation channel 78, and that restricts a flow of the fluid in a direction opposite to the flowing direction. For example, the first one-way valve 87 may be provided in the branch region at a position between the pressure sensor 86 and the filter unit 80. The first one-way valve 87 allows a flow of the fluid from the second position P2 to the filter unit 80, and restricts a flow of the fluid in the opposite direction.

The second one-way valve 88 may be provided in the joint region at a position between the circulation pump 79 and the first position Pl. The second one-way valve 88 allows a flow of the fluid from the circulation pump 79 to the first position P1, and restricts a flow of the fluid in the opposite direction. In the joint region, the reservoir 72 may be also provided between the second one-way valve 88 and the first position P1.

An on-off valve 91 is provided in the communication channel 81. The on-off valve 91 causes the communication channel 81 to be open when a gas discharge unit 92 is attached, and causes the communication channel 81 to be closed when the gas discharge unit 92 is detached. If the gas discharge unit 92 is attached, the communication channel 81 communicates with a gas discharge channel 93 included in the gas discharge unit 92.

The gas discharge unit 92 includes the gas discharge channel 93 for discharging gas to the outside, an inflow restrictor 94 configured to restrict mixing of fluid into the communication channel 81 from the outside, and a gas-liquid separator 95 that separates gas and liquid from each other. The inflow restrictor 94 is, for example, a one-way valve that allows an outflow of fluid from the inside to the outside of the communication channel 81, and restricts an inflow of gas (air) from the outside to the communication channel 81 and a backflow of fluid from the inside of the gas discharge channel 93 to the filter unit 80. The gas-liquid separator 95 is provided downstream of the inflow restrictor 94, allows discharge of gas from the gas discharge channel 93, and restricts discharge of liquid from the gas discharge channel 93.

Figure 6:
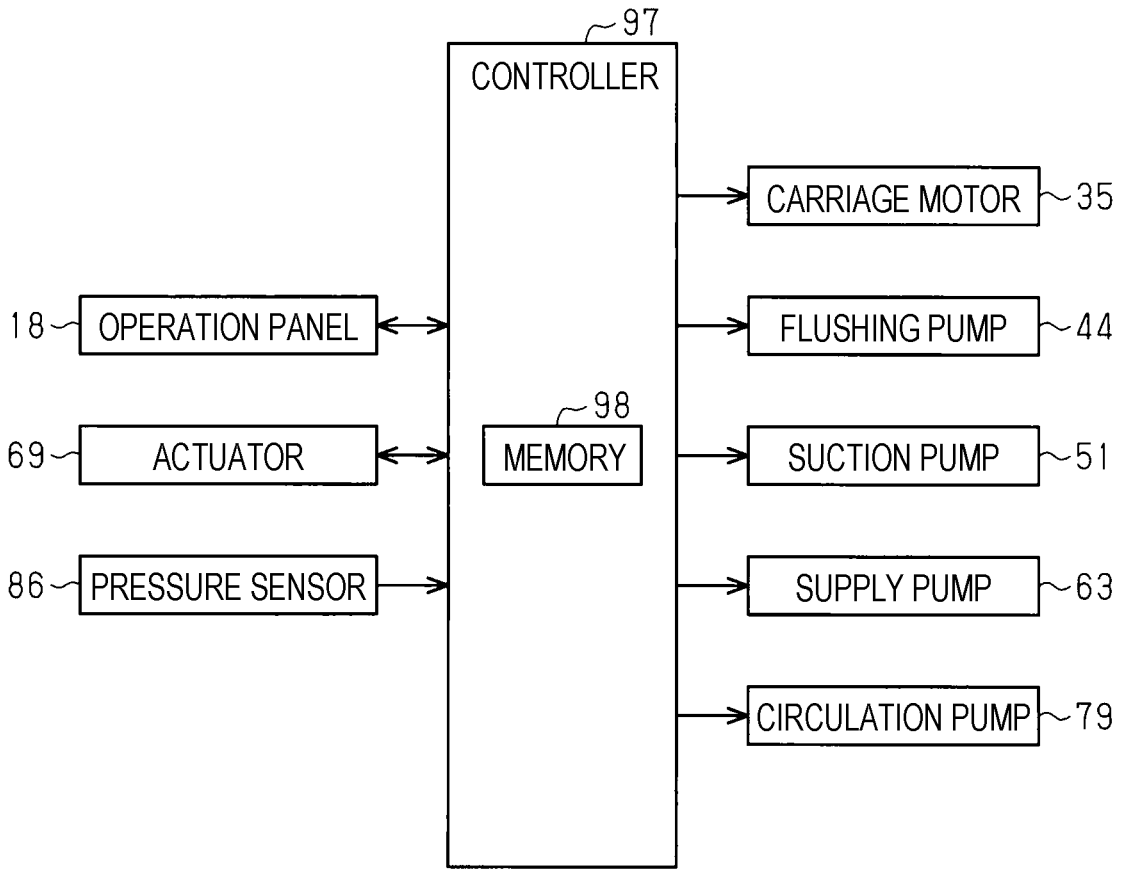
FIG. 6 is a block diagram showing the electric configuration of the liquid ejecting apparatus in FIG. 1.

As shown in FIG. 6, the liquid ejecting apparatus 11 includes a controller 97 that controls components including the operation panel 18, the carriage motor 35, the flushing pump 44, the suction pump 51, the supply pump 63, the actuators 69, and the circulation pump 79. The controller 97 includes a memory 98 that stores a program used for control on the components. The controller 97 executes various processing by executing the program stored in the memory 98. The controller 97 is electrically coupled to the pressure sensor 86.

The controller 97 executes processing of presuming the level of clogging of the second filter 83 at a predetermined timing. For example, the pressure value detected by the pressure sensor 86 while the circulation pump 79 is not driven is used as a stop pressure value, and the pressure value detected by the pressure sensor 86 while the circulation pump 79 is driven is used as a driving pressure value. The controller 97 causes the memory 98 to store the stop pressure value and the driving pressure value. When the difference between the stop pressure value and the driving pressure value is larger than a predetermined threshold, the controller 97 presumes that the second filter 83 is clogged at a level at which replacement is required. At this time, the controller 97 functions as a presuming unit that presumes the level of clogging of the second filter 83 based on the driving state of the circulation pump 79 and the pressure value detected by the pressure sensor 86.

The threshold used for the presumption may be previously calculated through experiment or simulation and stored in the memory 98 included in the controller 97; or may be input by a user through the operation panel 18 or the like. If the controller 97 presumes that the second filter 83 is clogged at the level at which replacement is required, the user is notified of the presumption through the operation panel 18 or the like, and the filter unit 80 is replaced at a proper timing.

An embodiment of the pressure regulating mechanism 75 is described next.

Figure 7:
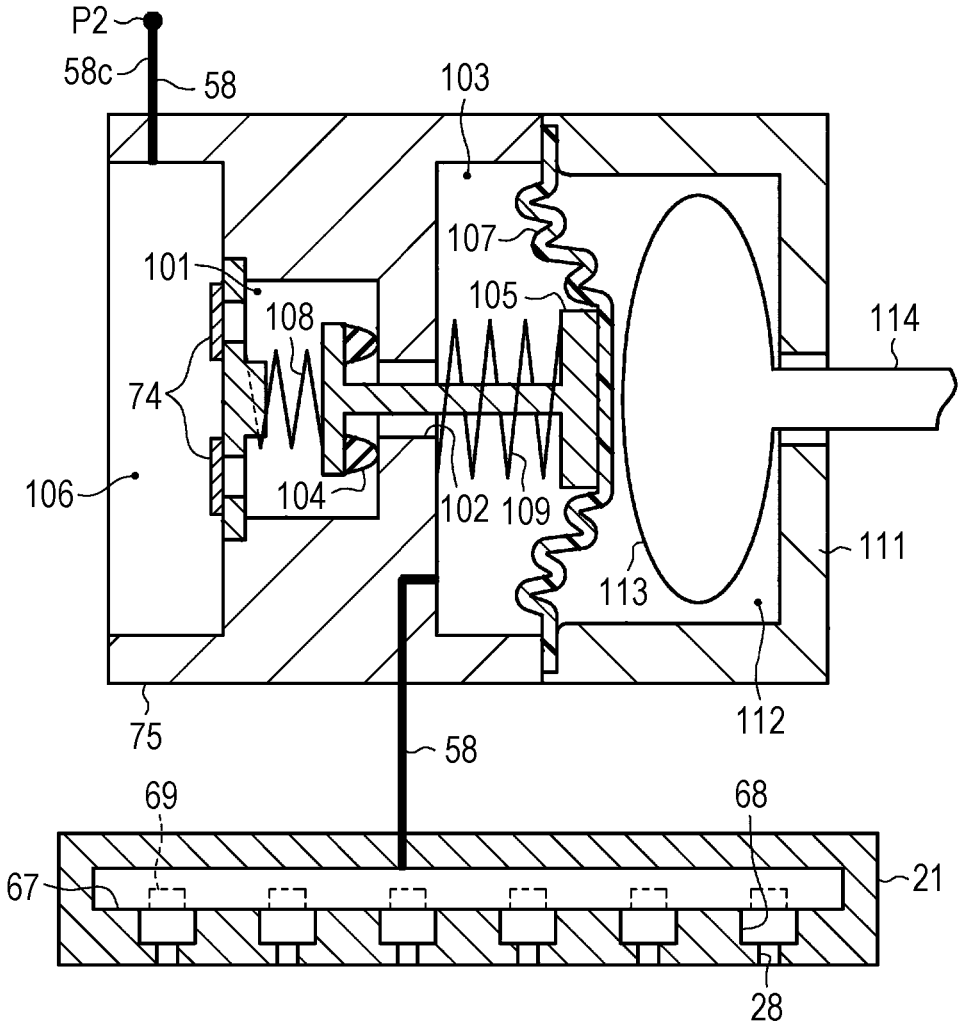
FIG. 7 is a cross-sectional view of a pressure regulating mechanism included in the liquid ejecting apparatus in FIG. 1.

As shown in FIG. 7, the pressure regulating mechanism 75 includes a supply chamber 101 provided at an intermediate position of the liquid path 58, a pressure chamber 103 configured to communicate with the supply chamber 101 through a communication hole 102, a valve body 104 configured to open/close the communication hole 102, and a pressure receiving member 105 whose proximal end side is housed in the supply chamber 101 and whose distal end side is housed in the pressure chamber 103. The supply chamber 101, the communication hole 102, and the pressure chamber 103 constitute a portion of the liquid path 58 that supplies the liquid to the nozzles 28.

The valve body 104 is formed of, for example, a ring-shaped elastic body attached to surround the proximal end portion of the pressure receiving member 105 located in the supply chamber 101. A rod-shaped portion extending from a thin-plate-shaped pressure receiving portion provided on the distal end side of the pressure receiving member 105 to the supply chamber 101 may be divided at an intermediate position, and a rod-shaped portion located on the supply chamber 101 side may be integrated with the valve body 104. A first filter 74 may be provided at, for example, an inlet of the supply chamber 101. The first filter 74 is provided to separate the supply chamber 101 on the downstream side and an upstream chamber 106 on the upstream side from each other. The supply chamber 101 and the upstream chamber 106 are increased width portions having channel cross-sectional areas larger than the channel cross-sectional area of the liquid path 58 that is located upstream of the upstream chamber 106.

Wall surfaces of the pressure chamber 103 are partly formed of a flexible film 107 that is flexibly displaceable. The pressure regulating mechanism 75 also includes a first urging member (first bias member) 108 that is housed in the supply chamber 101, and a second urging member (second bias member) 109 that is housed in the pressure chamber 103. The first urging member 108 urges (biases) the valve body 104 in a direction in which the communication hole 102 is closed via the pressure receiving member 105.

The pressure receiving member 105 is displaced when being pressed by the flexible film 107 that is flexibly displaceable in a direction in which the capacity of the pressure chamber 103 is decreased. Also, the flexible film 107 is flexibly displaced in the direction in which the capacity of the pressure chamber 103 is decreased, when the internal pressure of the pressure chamber 103 is decreased due to discharge of fluid from the nozzles 28. If the pressure (internal pressure) applied to the surface on the inner side, which is on the pressure chamber 103 side, of the flexible film 107 is lower than the pressure (external pressure) applied to the surface on the outer side, which is opposite to the pressure chamber 103, of the flexible film 107, and if the difference between the pressure applied to the surface on the inner side and the pressure applied to the surface on the outer side is a setting value (for example, 1 kPa) or larger, the pressure receiving member 105 is displaced, and the valve body 104 is changed to an open valve state from a closed valve state.

The setting value is a value determined based on the urging forces of the first urging member 108 and the second urging member 109, the force required for displacing the flexible film 107, the pressing force (sealing load) required for closing the communication hole 102 with the valve body 104, and the pressure in the supply chamber 101 and the pressure in the pressure chamber 103 that act on the supply chamber 101 side of the pressure receiving member 105 and on the surface of the valve body 104. That is, the setting value is larger as the urging forces of the first urging member 108 and the second urging member 109 are larger. The urging forces of the first urging member 108 and the second urging member 109 are set to, for example, −1 kPa if the pressure in the pressure chamber 103 is a negative-pressure state in a range in which menisci can be formed at gas-liquid interfaces of the nozzles 28 (for example, if the pressure applied to the surface on the outside of the flexible film 107 is the atmospheric pressure, −1 kPa).

When the communication hole 102 is opened and the fluid flows from the supply chamber 101 into the pressure chamber 103, the internal pressure of the pressure chamber 103 increases. Then, if the internal pressure of the pressure chamber 103 becomes the above-described setting value, the valve body 104 closes the communication hole 102. Even when the fluid is supplied to the supply chamber 101 with a pressure and when the fluid is discharged from the nozzles 28, the pressure from the pressure chamber 103 to the cavities 68 (back pressure of the nozzles 28) is maintained substantially at the setting value.

In this embodiment, the pressure regulating mechanism 75 is arranged in the downstream channel 58*c* extending from the second position P2 of the liquid path 58 toward the liquid ejecting unit 21. The valve body 104 configured to switch the liquid path 58 between the communication state and the non-communication state is provided, and if the pressure in the region located downstream of the valve body 104 is lower than the setting value that is lower than the pressure in the external space, the valve body 104 autonomously switches the liquid path 58 (communication hole 102) from the communication state to the non-communication state. Hence, the pressure regulating mechanism 75 is classified into a differential pressure valve (among differential pressure valves, in particular, pressure reducing valve).

The pressure regulating mechanism 75 may additionally include a valve opening mechanism 111 that forcedly opens the communication hole 102 and supplies the liquid to the liquid ejecting unit 21. The valve opening mechanism 111 includes, for example, a pressure applying bag 113 that is housed in a housing chamber 112 separated from the pressure chamber 103 by the flexible film 107, and a pressure applying channel 114 that causes gas to flow into the pressure applying bag 113. The pressure applying bag 113 is inflated with the gas flowing thereinto via the pressure applying channel 114, the inflated pressure applying bag 113 flexibly displaces the flexible film 107 in a direction in which the capacity of the pressure chamber 103 is decreased, and hence the communication hole 102 is forcedly opened. Since the valve opening mechanism 111 forcedly opens the communication hole 102, the liquid path (communication hole 102) can be forcedly switched from the non-communication state to the communication state.

An embodiment of the filter unit 80 is described next.

Figure 8:
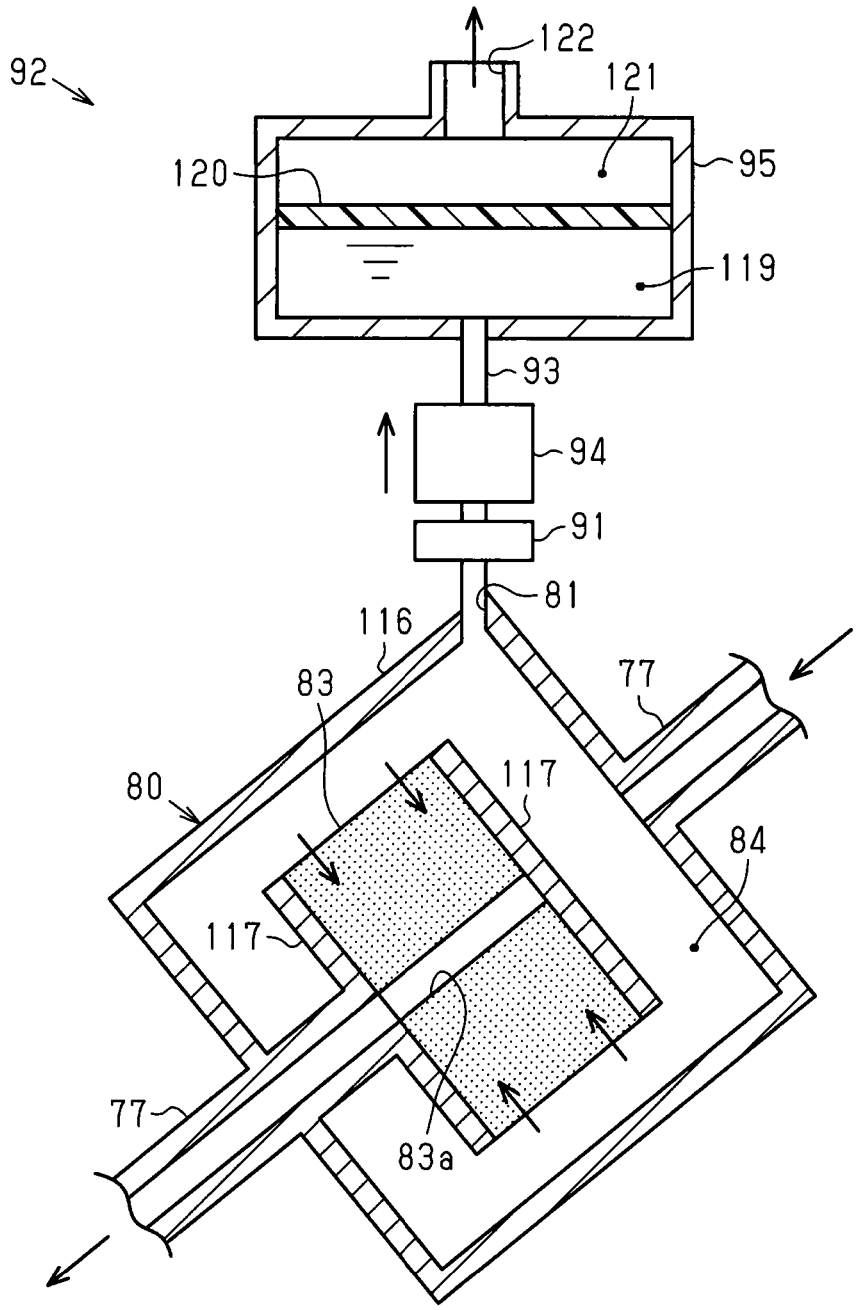
FIG. 8 is a cross-sectional view of a filter unit and an inflow restrictor included in the liquid ejecting apparatus in FIG. 1.

As shown in FIG. 8, the filter unit 80 includes a cylindrical case 116. The second filter 83 is cylindrical, and is arranged in the case 116 coaxially with the case 116. The return channel 77 is connected to circular bottom and upper surfaces of the cylindrical case 116. The upstream filter chamber 84 is formed between the case 116 and the second filter 83 to surround the second filter 83, and hence constitutes a portion of the return channel 77.

The second filter 83 has a hole 83*a* defined by a cylindrical inner peripheral surface of the second filter 83. A bottom surface portion and an upper surface portion of the second filter 83 are closed with disk-shaped support plates 117. The upper end of the hole 83*a* is closed with the support plate 117 on the upper surface side, and the lower end side of the hole 83*a* penetrates through the support plate 117 on the bottom surface side. The space in the hole 83*a* is located on the secondary side of the second filter 83, and constitutes the joint region of the return channel 77.

The filter unit 80 is desirably tilted such that the primary side (upstream side) is higher than the secondary side (downstream side). The communication channel 81 is desirably connected to an upper end portion in the vertical direction of the upstream filter chamber 84. Accordingly, the gas which has entered the upstream filter chamber 84 stays in a corner portion at the highest position in the upstream filter chamber 84. Thus, gas more likely enters the communication channel 81 than liquid.

When the fluid enters the filter unit 80 from the branch region on the upstream side in the return channel 77, the fluid is temporarily stored in the upstream filter chamber 84, then enters the second filter 83 through the outer peripheral surface of the second filter 83, and reaches the hole 83*a*. At this time, abnormal substances containing air bubbles are collected (trapped) by the second filter 83. The air bubbles collected by the second filter 83 stay in the upper portion of the upstream filter chamber 84, and flow to the outside of the channel through the communication channel 81 and the gas discharge channel 93. The liquid from which abnormal substances have been filtered out by the second filter 83 moves to the joint region on the downstream side of the filter unit 80 through the hole 83*a*. The direction in which the fluid flows in the configuration in FIG. 8 is indicated by arrows.

An embodiment of the gas-liquid separator 95 is described next.

As shown in FIG. 8, the gas-liquid separator 95 includes a degassing chamber 119 that temporarily stores the liquid at the terminal of the gas discharge channel 93, a gas discharge chamber 121 separated from the degassing chamber 119 by a degassing film 120, and a gas discharge channel 122 that allows the gas discharge chamber 121 to communicate with the outside. The degassing film 120 has characteristics of allowing gas to pass therethrough, but inhibiting liquid from passing therethrough. The degassing film 120 may employ, for example, a film formed by subjecting polytetrafluoroethylene (PTFE) to special drawing and making multiple fine pores of about 0.2 micrometers in the film. When the liquid containing the gas flows into the degassing chamber 119, only the gas passes through the degassing film 120, enters the gas discharge chamber 121, and is discharged to the outside through the gas discharge channel 122. Thus, the air bubbles and dissolved gas mixed into the liquid stored in the degassing chamber 119 are eliminated while the liquid is not discharged from the gas discharge channel 93.

A maintenance method for the liquid ejecting apparatus 11 is described next.

Figure 9:
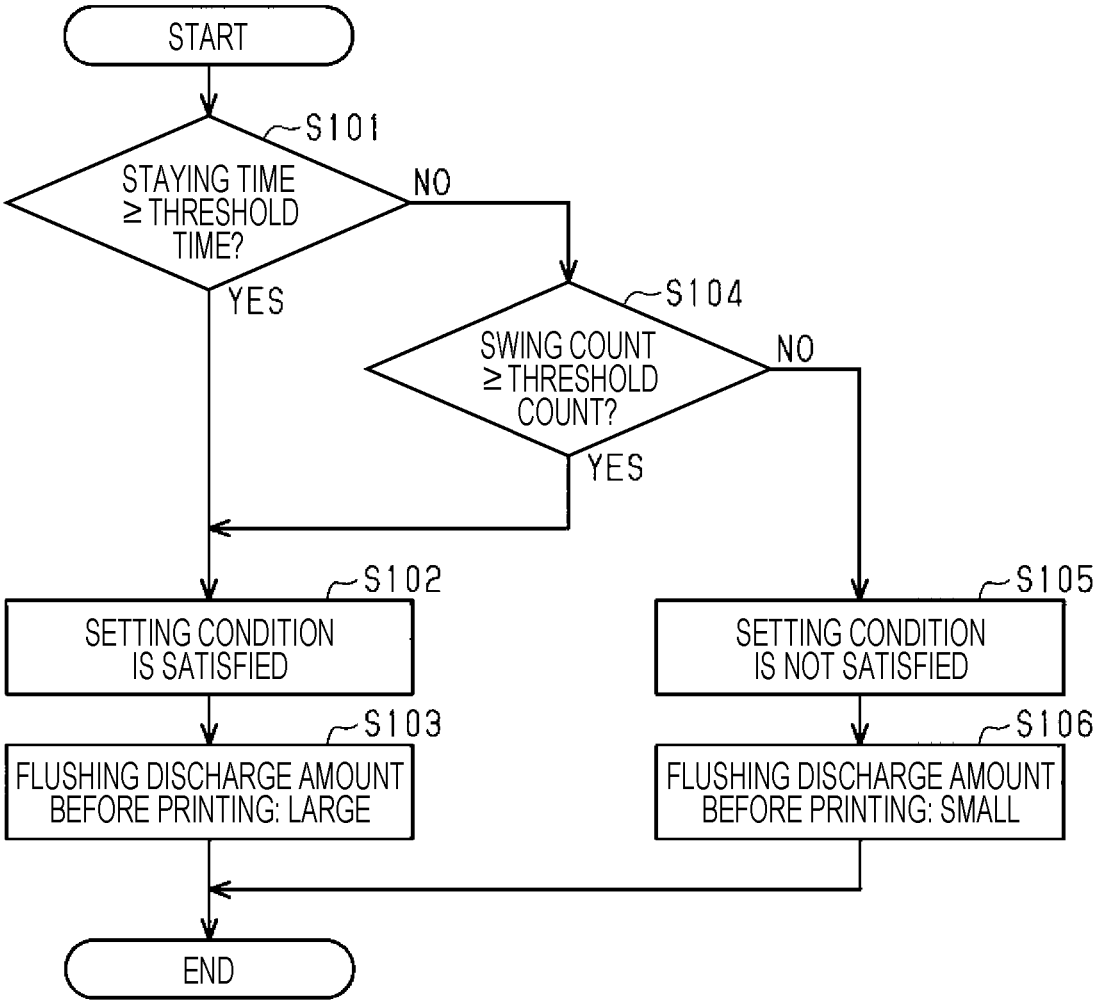
FIG. 9 is a flowchart showing a maintenance processing routine.

A maintenance processing routine shown in FIG. 9 is executed, when print information for performing printing on a target T is input, before printing based on the print information is started.

As shown in FIG. 9, in step S101, the controller 97 determines whether a staying time in which the liquid stays in the liquid path 58 during printing is a threshold time or longer, based on the print information.

If it is presumed that the staying time is the threshold time or longer (step S101: YES), in step S102, the controller 97 determines that printing based on the print information is printing satisfying a setting condition. In step S103, the controller 97 increases the discharge amount of the liquid to be discharged during the pre-print flushing.

If it is presumed that the staying time is shorter than the threshold time (step S101: NO), in step S104, the controller 97 determines whether a swing count (the number of times of swing) per unit time when the holder 22 reciprocates is a threshold count or larger based on the print information. If the swing count is the threshold count or larger (step S104: YES), the controller 97 moves the processing to step S102.

If the swing count is smaller than the threshold count (step S104: NO), in step S105, the controller 97 presumes that printing based on the print information is printing not satisfying the setting condition. In step S106, the controller 97 decreases the discharge amount of the liquid to be discharged during the pre-print flushing.

That is, when printing satisfying the setting condition is performed, the controller 97 sets the discharge amount of the liquid to be discharged during the pre-print flushing for the maintenance processing that is performed before printing, to be larger than a case where printing not satisfying the setting condition is performed.

Advantageous effects of the liquid ejecting apparatus 11 are described next.

Liquid may be aggregated as time elapses or vibration is applied. The aggregated matters may become abnormal substances. Likelihood of occurrence of aggregation varies depending on the kind of liquid. The aggregated matters in the liquid increase as the time in which the liquid stays in the liquid path 58 increases. The liquid which is used for base printing (for example, white ink) is more likely aggregated as compared with liquid which is used for main printing (for example, color ink).

A portion of the liquid path 58 moves with the movement of the holder 22. The liquid in the moving portion of the liquid path 58 vibrates, and is more likely aggregated than the non-moving portion. Thus, the staying time that is compared with the threshold time is desirably a time in which the liquid stays in the moving portion of the liquid path 58.

A liquid surface is likely formed particularly in a portion, such as an increased width portion, of the liquid path 58 where the air likely stays. When the liquid surface is formed, the liquid surface waves and easily vibrates, likely causing aggregation. Owing to this, when the first filter 74 moves with the movement of the holder 22, aggregation likely occurs in the periphery of the first filter 74. When the liquid is aggregated particularly in the upstream chamber 106, the first filter 74 may be clogged with the aggregated matters.

The liquid ejecting apparatus 11 checks whether the setting condition is satisfied based on the print information for performing printing on a target T before printing is started. When printing which likely cause aggregation is performed, abnormal substances in the liquid path 58 are discharged before printing. Thus, even when aggregation occurs during printing and abnormal substances are generated, the amount of abnormal substances can be decreased.

The print information includes execution or non-execution of base printing. When printing including base printing is performed, base printing is performed before main printing. Base printing solidly provides printing in an area where main printing is to be performed. Therefore, base printing is what is called solid printing. The staying time of the liquid for base printing staying in the liquid path 58 is shorter than the threshold time. Hence, the controller 97 determines printing not including base printing as printing satisfying the setting condition, and determines printing including base printing as printing not satisfying the setting condition, based on the print information.

When base printing is performed, since the liquid for base printing is ejected first, the abnormal substances can be discharged by base printing from the liquid in the liquid path 58 that supplies the liquid for base printing. In contrast, when printing not including base printing is performed, since only main printing is performed, the abnormal substances in the liquid path 58 that supplies the liquid for base printing may be increased during main printing.

The staying time in the liquid path 58 is changed also depending on print quality. For example, the print information may include a print mode, such as high speed, normal, high definition, super high definition, or the like. The print quality increases in the order of high speed, normal, high definition, and super high definition. The staying time increases as the print quality increases. Hence, for example, the controller 97 may determine that the setting condition is not satisfied if high speed or normal is selected, and may determine that the setting condition is not satisfied if high definition or super high definition is selected.

Execution of printing including base printing is described next.

Printing including base printing is printing not satisfying the setting condition. It is assumed that base printing uses white ink and main printing uses color ink. In the following description, a first discharge amount by flushing is also referred to as small amount (for example, the total amount when 100 liquid droplets are ejected per nozzle), a second discharge amount larger than the small amount is also referred to as medium amount (for example, the total amount when 1000 liquid droplets are ejected per nozzle), and a third discharge amount larger than the medium amount is also referred to as large amount (for example, the total amount when 10000 liquid droplets are ejected per nozzle). The large amount is desirably about 10 to 100 times the medium amount, and the medium amount is desirably about 10 to 100 times the small amount.

The controller 97 executes the pre-print flushing, base printing, and main printing sequentially in that order, and executes the in-print flushing during base printing and main printing. In the pre-print flushing, the liquid ejecting unit 21 ejects the medium amount of white ink and the medium amount of color ink. In the in-print flushing, the liquid ejecting unit 21 ejects the small amount of white ink and the small amount of color ink.

Execution of printing not including base printing is described next.

Printing not including base printing is printing satisfying the setting condition. The controller 97 executes the pre-print flushing and main printing sequentially in that order, and executes the in-print flushing during main printing. If the setting condition is satisfied and if it is presumed that the time in which the liquid stays in the liquid path 58 during printing is longer than that in the case where the setting condition is not satisfied, the discharge amount of the liquid to be discharged during the pre-print flushing is set to be larger than the case where the setting condition is not satisfied.

Specifically, in the pre-print flushing, the liquid ejecting unit 21 ejects the large amount of white ink and the medium amount of color ink. Thus, when printing satisfying the setting condition is performed, the discharge amount of the liquid to be used for base printing and discharged during the maintenance processing that is performed before printing is set to be larger than the case where printing not satisfying the setting condition is performed.

If the setting condition is satisfied, the discharge amount of white ink to be discharged during the maintenance processing that is performed before printing is set to the capacity or larger of a portion of the liquid path 58 located downstream of the first filter 74. The large amount is desirably larger than the capacity of a portion of the liquid path 58 located between the first filter 74 and the nozzles 28.

The flow amount ($m^3/s$) of white ink flowing in the liquid path 58 during the pre-print flushing is set to the maximum value or larger of the flow amount of white ink flowing in the liquid path 58 during printing. When the pre-print flushing is performed, the ejection amount (the number of droplets)

per unit time of white ink is desirably larger than the maximum ejection amount per unit time during the in-print flushing.

The flow amount of the liquid flowing in the liquid path 58 during the maintenance processing that is performed before printing is set such that the abnormal substances trapped by the first filter 74 can pass through the first filter 74. The abnormal substances (in particular, aggregated matters) trapped by the first filter 74 may pass through the first filter 74 when the flow amount is increased. When flushing of ejecting the large amount of white ink is performed, the abnormal substances trapped by the first filter 74 provided in the liquid path 58 for white ink desirably at least partly pass through the first filter 74.

In the in-print flushing, the liquid ejecting unit 21 ejects the small amount of white ink and the small amount of color ink. If the setting condition is satisfied, the discharge amount of the liquid to be discharged during the in-print flushing is smaller than the discharge amount of the liquid to be discharged during the pre-print flushing.

With the above-described embodiment, the following advantageous effects can be obtained.

(1) Liquid includes a kind of liquid that air bubbles and abnormal substances contained in the liquid likely increase as the staying time of the liquid staying in the liquid path 58 increases. Owing to this, if printing with a long staying time is performed while many air bubbles and abnormal substances are contained in the liquid in the liquid path 58 before printing, printing may not be properly performed due to the air bubbles and abnormal substances which have increased during printing. In this case, the specifications of the maintenance processing that is performed before the printing are determined based on the print information for printing. Specifically, if printing with a long staying time of the liquid staying in the liquid path 58 is performed, the discharge amount of the liquid to be discharged during the maintenance processing that is performed before printing is set to be larger than that in the case of printing with a short staying type, the liquid which may contain air bubbles and abnormal substances is discharged in advance, and then printing is performed. Hence, even when air bubbles and abnormal substances are generated during printing, the amounts of air bubbles and abnormal substances contained in the liquid can be decreased as compared with the case where the discharge amount of discharge before printing is small, thereby stably supplying the liquid to the nozzles 28.

(2) The flow amount of the liquid flowing in the liquid path 58 during the pre-print flushing is set to the maximum value or larger of the flow amount of the liquid flowing in the liquid path 58 during printing. Even when air bubbles and abnormal substances are contained in the liquid, flowability of the liquid in the liquid path 58 can be increased by the pre-print flushing.

(3) When printing that likely causes increases in air bubbles and abnormal substances is performed, the discharge amount of discharge before printing is increased, the liquid in the liquid path 58 is discharged in advance, and then printing is performed. Hence, even when the discharge amount of the liquid to be discharged during the in-print flushing is decreased, likelihood of occurrence of a print failure can be reduced. Thus, the liquid can be stably supplied while the consumption of the liquid is decreased.

(4) In the maintenance processing that is performed before printing, the liquid is discharged by an amount corresponding to the capacity or larger of the portion of the liquid path 58 located downstream of the first filter 74. Thus, the liquid containing air bubbles and abnormal substances which are located downstream of the first filter 74 and hence are not trapped by the first filter 74 can be discharged before printing.

(5) The flow amount of the liquid flowing in the liquid path 58 during the maintenance processing that is performed before printing is set such that the abnormal substances trapped by the first filter 74 can pass through the first filter 74. Thus, the possibility that the first filter 74 is clogged with the abnormal substances can be reduced.

(6) Liquid which is used for base printing among a plurality of kinds of liquid includes a kind of liquid which likely generates abnormal substances as compared with the other kinds of liquid. In this case, when base printing is not performed, the discharge amount of the liquid to be used for base printing is increased during the maintenance processing before printing. Thus, since the abnormal substances in the liquid are decreased before printing, the liquid can be stably supplied to the nozzles 28 even when the abnormal substances are generated in the liquid by printing not including base printing.

The above-described embodiments may be modified like modifications described below. Any of the embodiments may be desirably combined with any of the modifications. Configurations included in the modifications may be desirably combined with one another.

The liquid ejecting apparatus 11 may presume the staying time of each color of color ink based on the print information. If the staying time is long, it is determined that the setting condition is satisfied. The discharge amount of the liquid satisfying the setting condition may be increased during the maintenance processing that is performed before printing.

When the circulation channel 78 partly moves with the holder 22, the controller 97 may drive the circulation pump 79 during printing and may cause the liquid to circulate in the circulation channel 78. Thus, the liquid in the portion where the liquid is likely aggregated with the movement of the holder 22 can be exchanged.

The second end of the return channel 77 may be connected to the common liquid chamber 67. That is, the second position P2 may be provided in the common liquid chamber 67. The circulation channel 78 may be formed so as to include the liquid ejecting unit 21. Even if the setting condition is satisfied, the maintenance processing before printing may be performed similarly to the case where the setting condition is not satisfied, and the liquid in the circulation channel 78 may be circulated during printing. The liquid located in the portion of the circulation channel 78 where the liquid is likely aggregated may be exchanged by circulating the liquid.

The second end of the return channel 77 may be connected to a partial channel of the liquid path 58 located between the first filter 74 and the pressure regulating mechanism 75. The second end of the return channel 77 may be connected to the supply chamber 101. The circulation pump 79 may circulate the liquid so as to flow into the upstream chamber 106 located upstream of the first filter 74 from the supply chamber 101 located downstream of the first filter 74. Thus, the abnormal substances trapped by the first filter 74 are removed from the first filter 74, and the removed abnormal substances can be trapped by the second filter 83.

The liquid ejecting unit 21 may have one nozzle group 29. The liquid ejecting apparatus 11 may have one liquid path 58. The liquid ejecting apparatus 11 may be, for example, a monochrome printer that ejects one kind of liquid.

The plurality of kinds of liquid which are ejected by the liquid ejecting apparatus 11 may not include the liquid which is used for base printing. The liquid ejecting apparatus 11 may not execute base printing.

The flow amount of the liquid flowing in the liquid path 58 during the maintenance processing that is performed before printing may be changed during the maintenance processing. For example, the ejection amount per unit time may be changed during the pre-print flushing. The period in which the flow amount of the liquid flowing in the liquid path 58 during the maintenance processing that is performed before printing is larger than the flow amount that allows the abnormal substances trapped by the first filter 74 can pass through the first filter 74 may be a partial period of the maintenance processing.

The liquid ejecting apparatus 11 may not include the first filter 74.

The flow amount of the liquid flowing in the liquid path 58 during the maintenance processing that is performed before printing may be set such that the abnormal substances trapped by the first filter 74 cannot pass through the first filter 74.

If the setting condition is satisfied, the discharge amount of the liquid to be discharged during the maintenance processing that is performed before printing is set to the capacity or smaller of the portion of the liquid path 58 located downstream of the first filter 74.

If the setting condition is satisfied, the total amount of the discharge amount of the liquid to be discharged during the pre-print flushing and the discharge amount of the liquid to be discharged during the in-print flushing may be the capacity or larger of the portion of the liquid path 58 located downstream of the first filter 74.

The maintenance processing that is performed before printing is not limited to flushing. The maintenance processing may be suction cleaning. The maintenance processing may be pressure cleaning of driving the supply pump 63 while the liquid path 58 is in communication by the valve opening mechanism 111. The liquid may be supplied with a pressure from the liquid supply source 54, and discharged from the nozzles 28.

Even if the setting condition is satisfied, the discharge amount of the liquid to be discharged during the in-print flushing may be equal to or larger than the discharge amount of the liquid to be discharged during the pre-print flushing.

The flow amount of the liquid flowing in the liquid path 58 during the pre-print flushing may be set to the maximum value or smaller of the flow amount of the liquid flowing in the liquid path 58 during printing.

The target T is not limited to a sheet of paper or a fabric used for a T-shirt or the like, and may be a plastic film, a thin plate material, or a long fabric which is used for a textile printing machine or the like.

The liquid to be ejected from the liquid ejecting unit 21 is not limited to ink. For example, the liquid may be a liquid-like body in which particles made of a functional material are dispersed or mixed. For example, recording may be performed by ejecting a liquid-like body containing a material, such as an electrode material or a colorant (pixel material), which is used for manufacturing a liquid crystal display, an electroluminescence (EL) display, or a surface emitting display, in a dispersed manner or a dissolved manner.

Hereinafter, technical ideas and advantageous effects thereof recognized from the above-described embodiments and modifications are described below.

Idea 1

A liquid ejecting apparatus includes a liquid ejecting unit that performs printing on a target by ejecting liquid from a plurality of nozzles; a liquid supply channel configured to supply the liquid which is stored in a liquid supply source toward the liquid ejecting unit; and a maintenance section that performs maintenance processing of causing the liquid to be discharged from the nozzles. Based on print information for performing printing on the target, printing satisfying a setting condition is determined if a staying time of the liquid staying in a liquid path including the liquid supply channel and a channel extending from the liquid supply channel to the nozzles during printing is presumed to be long, and printing not satisfying the setting condition is determined if the staying time is presumed to be short. When the printing satisfying the setting condition is performed, a discharge amount of the liquid to be discharged during the maintenance processing that is performed before printing is set to be larger than a discharge amount of the liquid when the printing not satisfying the setting condition is performed.

Liquid includes a kind of liquid that air bubbles and abnormal substances contained in the liquid likely increase as the staying time of the liquid staying in the liquid path increases. Owing to this, if printing with a long staying time is performed while many air bubbles and abnormal substances are contained in the liquid in the liquid path before printing, printing may not be properly performed due to the air bubbles and abnormal substances which have increased during printing. In this case, with this configuration, the specifications of the maintenance processing that is performed before the printing are determined based on the print information for printing. Specifically, if printing with a long staying time of the liquid staying in the liquid path is performed, the discharge amount of the liquid to be discharged during the maintenance processing that is performed before printing is set to be larger than that in the case of printing with a short staying time, the liquid which may contain air bubbles and abnormal substances is discharged in advance, and then printing is performed. Hence, even when air bubbles and abnormal substances are generated during printing, the amounts of air bubbles and abnormal substances contained in the liquid can be decreased as compared with the case where the discharge amount of discharge before printing is small, thereby stably supplying the liquid to the nozzles.

Idea 2

In the liquid ejecting apparatus according to Idea 1, the maintenance processing includes flushing of driving an actuator included in the liquid ejecting unit and causing the liquid to be ejected; the flushing is performed as pre-print flushing for the maintenance processing that is performed before printing; and a flow amount of the liquid flowing in the liquid path during the pre-print flushing is set to a maximum value or larger of a flow amount of the liquid flowing in the liquid path during printing.

With this configuration, the flow amount of the liquid flowing in the liquid path during the pre-print flushing is set to the maximum value or larger of the flow amount of the liquid flowing in the liquid path during printing. Even when air bubbles and abnormal substances are contained in the liquid, flowability of the liquid in the liquid path can be increased by the pre-print flushing.

Idea 3

In the liquid ejecting apparatus according to Idea 1 or Idea 2, the maintenance processing includes flushing of driving an actuator included in the liquid ejecting unit and causing the liquid to be ejected; the flushing is performed as pre-print flushing for the maintenance processing that is performed before printing, and in-print flushing for the maintenance processing that is performed during printing; and if the setting condition is satisfied, a discharge amount of the liquid to be discharged during the in-print flushing is smaller than a discharge amount of the liquid to be discharged during the pre-print flushing.

With this configuration, when printing that likely causes increases in air bubbles and abnormal substances is performed, the discharge amount of discharge before printing is increased, the liquid in the liquid path is discharged in advance, and then printing is performed. Hence, even when the discharge amount of the liquid to be discharged during the in-print flushing is decreased, likelihood of occurrence of a print failure can be reduced. Thus, the liquid can be stably supplied while the consumption of the liquid is decreased.

Idea 4

The liquid ejecting apparatus according to any one of Idea 1 to Idea 3 includes a filter that is provided in the liquid path and that allows the liquid to pass therethrough. If the setting condition is satisfied, the discharge amount of the liquid to be discharged during the maintenance processing that is performed before printing is set to a capacity or larger of a portion of the liquid path located downstream of the filter.

With this configuration, in the maintenance processing that is performed before printing, the liquid is discharged by an amount corresponding to the capacity or larger of the portion of the liquid path located downstream of the filter. Thus, the liquid containing air bubbles and abnormal substances which are located downstream of the filter and hence are not trapped by the filter can be discharged before printing.

Idea 5

The liquid ejecting apparatus according to any one of Idea 1 to Idea 4 includes a filter provided in the liquid path and configured to trap abnormal substances in the liquid. A flow amount of the liquid flowing in the liquid path during the maintenance processing that is performed before printing is set so as to allow the abnormal substances trapped by the filter to pass through the filter.

With this configuration, the flow amount of the liquid flowing in the liquid path during the maintenance processing that is performed before printing is set such that the abnormal substances trapped by the filter can pass through the filter. Thus, the possibility that the filter is clogged with the abnormal substances can be reduced.

Idea 6

The liquid ejecting apparatus according to any one of Idea 1 to Idea 5 includes the liquid ejecting unit including a plurality of nozzle groups formed to correspond to a plurality of kinds of the liquid so as to eject the plurality of kinds of the liquid; and a plurality of the liquid paths provided so as to supply the plurality of kinds of the liquid which are stored in liquid supply sources toward the plurality of corresponding nozzle groups. The plurality of kinds of the liquid include liquid which is used for base printing. Based on the print information, printing not including the base printing is determined as the printing satisfying the setting condition, and printing including the base printing is determined as the printing not satisfying the setting condition; and when the printing satisfying the setting condition is performed, the discharge amount of the liquid to be discharged during the maintenance processing that is performed before printing and to be used for the base printing is set to be larger than the discharge amount of the liquid when the printing not satisfying the setting condition is performed.

Liquid which is used for the base printing among a plurality of kinds of liquid includes a kind of liquid which likely generates abnormal substances as compared with the other kinds of liquid. In this case, with this configuration, when the base printing is not performed, the discharge amount of the liquid to be used for the base printing is increased during the maintenance processing before printing. Thus, since the abnormal substances in the liquid are decreased before printing, the liquid can be stably supplied to the nozzles even when the abnormal substances are generated in the liquid by the printing not including base printing.

Idea 7

A maintenance method for a liquid ejecting apparatus including a liquid ejecting unit that performs printing on a target by ejecting liquid from a plurality of nozzles, a liquid supply channel configured to supply the liquid which is stored in a liquid supply source toward the liquid ejecting unit, and a maintenance section that performs maintenance processing of causing the liquid to be discharged from the nozzles, includes checking whether a setting condition is satisfied based on print information for performing printing on the target; and if the setting condition is satisfied and if a time of the liquid staying in a liquid path including the liquid supply channel and a channel extending from the liquid supply channel to the nozzles during printing is presumed to be long, setting a discharge amount of the liquid to be discharged during the maintenance processing that is performed before printing, to be larger than a discharge amount of the liquid when the setting condition is not satisfied.

With this method, advantageous effects similar to those of the above-described liquid ejecting apparatus can be provided.

The entire disclosure of Japanese Patent Application No. 2017-214913, filed Nov. 7, 2017 is expressly incorporated by reference herein.

What is claimed is:

1. A liquid ejecting apparatus comprising:

a liquid ejecting unit that performs printing on a target by ejecting liquid from a plurality of nozzles;

a liquid supply channel configured to supply the liquid which is stored in a liquid supply source toward the liquid ejecting unit;

a maintenance section that performs maintenance processing of causing the liquid to be discharged from the nozzles; and a controller that performs the following prior to performing the printing on the target, based on print information related to the printing, determines whether the printing satisfies a setting condition, the setting condition comprising that a staying time of the liquid staying in a liquid path, including the liquid supply channel and a channel extending from the liquid supply channel to the nozzles, during printing is to be longer than a predetermined threshold time in a case where the setting condition is satisfied, sets a first discharge amount of the liquid to be discharged during the maintenance processing, in a case where the setting condition is not satisfied, sets a second discharge amount of the liquid to be discharged during the maintenance processing, the first discharge amount is greater than the second discharge amount, and causes the maintenance section to perform the maintenance processing based on the determined first discharge amount or second discharge amount.

2. The liquid ejecting apparatus according to claim 1, wherein the maintenance processing includes flushing of driving an actuator included in the liquid ejecting unit and causing the liquid to be ejected, wherein the flushing is performed as pre-print flushing for the maintenance processing that is performed before printing, and wherein a flow amount of the liquid flowing in the liquid path during the pre-print flushing is set to a maximum value or larger of a flow amount of the liquid flowing in the liquid path during printing.

3. The liquid ejecting apparatus according to claim 1, wherein the maintenance processing includes flushing of driving an actuator included in the liquid ejecting unit and causing the liquid to be ejected, wherein the flushing is performed as pre-print flushing for the maintenance processing that is performed before printing, and in-print flushing for the maintenance processing that is performed during printing, and wherein, if the setting condition is satisfied, a discharge amount of the liquid to be discharged during the in-print flushing is smaller than a discharge amount of the liquid to be discharged during the pre-print flushing.

4. The liquid ejecting apparatus according to claim 1, further comprising:

a filter that is provided in the liquid path and that allows the liquid to pass therethrough, wherein, if the setting condition is satisfied, the discharge amount of the liquid to be discharged during the maintenance processing that is performed before printing is set to a capacity or larger of a portion of the liquid path located downstream of the filter.

5. The liquid ejecting apparatus according to claim 1, further comprising:

a filter provided in the liquid path and configured to trap abnormal substances in the liquid, wherein a flow amount of the liquid flowing in the liquid path during the maintenance processing that is performed before printing is set so as to allow the abnormal substances trapped by the filter to pass through the filter.

6. The liquid ejecting apparatus according to claim 1, comprising: the liquid ejecting unit including a plurality of nozzle groups formed to correspond to a plurality of kinds of the liquid so as to eject the plurality of kinds of the liquid; and a plurality of the liquid paths provided so as to supply the plurality of kinds of the liquid which are stored in liquid supply sources toward the plurality of corresponding nozzle groups, wherein the plurality of kinds of the liquid include liquid which is used for base printing, and wherein the controller based on the print information, determines printing not including the base printing as the printing satisfying the setting condition, and determines printing including the base printing as the printing not satisfying the setting condition, and in a case where the printing satisfying the setting condition is performed, sets the discharge amount of the liquid to be discharged during the maintenance processing that is performed before printing and to be used for the base printing, to be larger than the discharge amount of the liquid in a case where the printing not satisfying the setting condition is performed.

7. A maintenance method for a liquid ejecting apparatus including a liquid ejecting unit that performs printing on a target by ejecting liquid from a plurality of nozzles, a liquid supply channel configured to supply the liquid which is stored in a liquid supply source toward the liquid ejecting unit, and a maintenance section that performs maintenance processing of causing the liquid to be discharged from the nozzles, the method comprising:

prior to performing the printing on the target, checking whether a setting condition is satisfied based on print information for performing printing on the target; the setting condition comprising that a time of the liquid staying in a liquid path including the liquid supply channel and a channel extending from the liquid supply channel to the nozzles during printing is to be longer than a predetermined threshold time, in response to a determination that the setting condition is satisfied, setting a first discharge amount of the liquid to be discharged during the maintenance processing in response to a determination that the setting condition is not satisfied, setting a second discharge amount of the liquid to be discharged during the maintenance processing, and causing the maintenance section to perform the maintenance processing based on the determined first discharge amount or second discharge amount.

8. The maintenance method for the liquid ejecting apparatus according to claim 7, wherein the maintenance processing includes flushing of driving an actuator included in the liquid ejecting unit and causing the liquid to be ejected, wherein the flushing is performed as pre-print flushing for the maintenance processing that is performed before printing, and wherein a flow amount of the liquid flowing in the liquid path during the pre-print flushing is set to a maximum value or larger of a flow amount of the liquid flowing in the liquid path during printing.

9. The maintenance method for the liquid ejecting apparatus according to claim 7, wherein the maintenance processing includes flushing of driving an actuator included in the liquid ejecting unit and causing the liquid to be ejected, wherein the flushing is performed as pre-print flushing for the maintenance processing that is performed before printing, and in-print flushing for the maintenance processing that is performed during printing, and wherein, if the setting condition is satisfied, a discharge amount of the liquid to be discharged during the in-print flushing is smaller than a discharge amount of the liquid to be discharged during the pre-print flushing.

10. The maintenance method for the liquid ejecting apparatus according to claim 7, wherein the liquid ejecting apparatus further includes a filter that is provided in the liquid path and that allows the liquid to pass therethrough, and wherein, if the setting condition is satisfied, a discharge amount of the liquid to be discharged during the maintenance processing that is performed before printing is set to a capacity or larger of a portion of the liquid path located downstream of the filter.

11. The maintenance method for the liquid ejecting apparatus according to claim 7, wherein the liquid ejecting apparatus further includes a filter provided in the liquid path and configured to trap abnormal substances in the liquid, and wherein a flow amount of the liquid flowing in the liquid path during the maintenance processing that is performed before printing is set so as to allow the abnormal substances trapped by the filter to pass through the filter.

12. The maintenance method for the liquid ejecting apparatus according to claim 7, wherein the liquid ejecting apparatus includes the liquid ejecting unit including a plurality of nozzle groups formed to correspond to a plurality of kinds of the liquid so as to eject the plurality of kinds of the liquid, and a plurality of the liquid paths provided so as to supply the plurality of kinds of the liquid which are stored in liquid supply sources toward the plurality of corresponding nozzle groups, wherein the plurality of kinds of the liquid include liquid which is used for base printing, wherein printing not including the base printing is determined as the printing satisfying the setting condition, and printing including the base printing is determined as the printing not satisfying the setting condition, based on the print information, and wherein, when the printing satisfying the setting condition is performed, the discharge amount of the liquid to be discharged during the maintenance processing that is performed before printing and to be used for the base printing, is set to be larger than the discharge amount of the liquid when the printing not satisfying the setting condition is performed.

* * * * *